US008818229B2

(12) United States Patent
Aoki

(10) Patent No.: US 8,818,229 B2
(45) Date of Patent: Aug. 26, 2014

(54) CURRENT-SUPPLY CONTROL UNIT, FUSING DEVICE, IMAGE FORMING APPARATUS, AND CURRENT-SUPPLY CONTROL METHOD

(75) Inventor: Toshimasa Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 156 days.

(21) Appl. No.: 13/411,685

(22) Filed: Mar. 5, 2012

(65) Prior Publication Data

US 2012/0237248 A1 Sep. 20, 2012

(30) Foreign Application Priority Data

Mar. 18, 2011 (JP) ..... 2011-061446
Dec. 19, 2011 (JP) ..... 2011-277439

(51) Int. Cl.
*G03G 15/00* (2006.01)
*H05B 1/02* (2006.01)
*G03G 15/20* (2006.01)

(52) U.S. Cl.
CPC ..... *G03G 15/2078* (2013.01); *G03G 15/205* (2013.01); *G03G 15/5004* (2013.01); *G03G 15/80* (2013.01)
USPC ..... 399/88; 219/497

(58) Field of Classification Search
CPC ..... G03G 15/2078; G03G 15/5004; G03G 15/205; G03G 15/80
USPC ..... 399/88; 219/497
See application file for complete search history.

(56) References Cited

U.S. PATENT DOCUMENTS

| | | | | |
|---|---|---|---|---|
| 5,818,670 | A * | 10/1998 | Ahn | 361/18 |
| 6,229,120 | B1 * | 5/2001 | Jewell | 219/486 |
| 2004/0105693 | A1 | 6/2004 | Akizuki et al. | |
| 2004/0188417 | A1 * | 9/2004 | Hori | 219/492 |
| 2004/0188418 | A1 | 9/2004 | Aisenbrey | |
| 2006/0083529 | A1 | 4/2006 | Akizuki et al. | |
| 2007/0193998 | A1 * | 8/2007 | Ichino | 219/216 |
| 2009/0033303 | A1 | 2/2009 | Kondo | |

FOREIGN PATENT DOCUMENTS

| | | | |
|---|---|---|---|
| CN | 1504840 | A | 6/2004 |
| CN | 101359871 | A | 2/2009 |
| JP | 2004-233745 | | 8/2004 |
| JP | 2006-039027 | A | 2/2006 |
| JP | 2006039027 | A * | 2/2006 |
| JP | 2010-181713 | A | 8/2010 |

OTHER PUBLICATIONS

European Search Report dated Oct. 12, 2012.
European Search Report dated Jun. 25, 2012.

* cited by examiner

*Primary Examiner* — David Gray
*Assistant Examiner* — Tyler Hardman
(74) *Attorney, Agent, or Firm* — Harness, Dickey & Pierce, P.L.C.

(57) ABSTRACT

A current-supply control unit for controlling current supply to a heating element includes a voltage detector and a heating element control unit. The voltage detector detects voltage at both ends of the heating element. The heating element control unit controls a duty cycle of current supply for the heating element based on the voltages detected by the voltage detector when current is supplied to the heating element.

14 Claims, 14 Drawing Sheets

CURRENT-SUPPLY CONTROL UNIT, FUSING DEVICE, IMAGE FORMING APPARATUS, AND CURRENT-SUPPLY CONTROL METHOD

CROSS-REFERENCE TO RELATED APPLICATIONS

This application claims priority to Japanese Patent Application Nos. 2011-061446, filed on Mar. 18, 2011 and 2011-277439, filed on Dec. 19, 2011 in the Japan Patent Office, which are incorporated by reference herein in their entirety.

BACKGROUND

1. Technical Field

The present invention relates to a current-supply control unit, a fusing device, an image forming apparatus, and a current-supply control method of controlling a heating element, and more particularly to a current-supply control unit for a heating unit to prevent overshooting and power shortage at the heating unit when a power supply is activated, a fusing device employing the current-supply control unit, an image forming apparatus employing the fusing device, and a current-supply control method of controlling the heating element.

2. Description of the Background Art

Electronic devices such as electro-photographic image forming apparatuses and other image forming apparatuses may have a heater such as a heating element used for fusing images on recording media. When such apparatuses detect an input of a power source, the heater is turned on. An amount of input power to the heater may be limited to a given value by setting a given duty cycle in view of the detected input voltage and a target temperature of the heater to prevent overshooting and power shortage at the heater. As for electro-photographic image forming apparatuses, fusing heaters can be controlled using a method that controls the duty cycle of voltage applied to the fusing heaters.

FIG. 1 shows a circuit configuration of a conventional fusing device 100 of an electro-photographic image forming apparatus. As shown in FIG. 1, the fusing device 100 includes, for example, a fusing heater 101, a relay 103, a fusing control circuit 104, an alternating current (AC) voltage detection circuit 105, and a control board 106. The control board 106 may include an application specific integrated circuit (ASIC) 107.

The fusing heater 101 is connected to a commercial alternating current (AC) power source 102 via the relay 103 to be supplied with heater-driving power for the fusing heater 101. Further, the fusing heater 101 is connected to the fusing control circuit 104serially. Further, the AC voltage detection circuit 105 is connected in parallel to the fusing heater 101. Specifically, the AC voltage detection circuit 105 is disposed between the relay 103 and the fusing control circuit 104, which is a stage before the fusing control circuit 104.

A signal detected by the AC voltage detection circuit 105 is input to the ASIC 107 of the control board 106. The ASIC 107 may correspond to a main controller. Based on the detection signal of the AC voltage detection circuit 105, the ASIC 107 selects a power-supply duty cycle to the fusing heater 101, and supplies a fusing control signal to the fusing control circuit 104 to control the fusing control circuit 104. FIG. 2 shows a timing chart for controlling a conventional fusing device, and FIG. 3 is a flow chart showing steps corresponding to the timing chart of FIG. 2.

As shown in FIGS. 2 and 3, when a main power source is set to ON (timing T1), a direct current (DC) power source is activated, a software processing is executed, and the relay 103 is set to ON (timing T2: step S201). When the relay 103 is set to ON, the voltage detection is started by activating the AC voltage detection circuit 105, and the AC/DC converting process is started using an AC/DC converter (step S202).

While the AC/DC converting process is conducted, the ASIC 107 sets the fusing heater 101 to ON state using a software start control after confirming the activation of the relay 103 (timing T3).

After completing the software start control, without setting a duty limit, the ASIC 107 outputs a fusing ON signal (ON signal of fusing heater) to set the fusing heater 101 at ON state (timing T4).

The ASIC 107 obtains DC converted by the AC/DC converter (step S203), and determines AC voltage based on a table stored in the ASIC 107 (step S204). Then, based on the AC voltage, the ASIC 107 sets or changes the upper limit of the duty cycle during which the fusing heater 101 is ON (step S205).

Based on such duty cycle, the ASIC 107 outputs the fusing ON signal or fusing heater ON signal (step S206), by which the fusing control circuit 104 is shifted to ON state while limiting the duty cycle (step S207), and the fusing heater 101 is set to ON state (timing T5).

Then, a temperature sensor such as a thermistor detects the heater temperature, and determines whether the heater temperature reaches a target temperature (step S208).

If the heater temperature does not reach the target temperature (S208: No), the process returns to step S206 and steps S206 to S208 are repeated. When the heater temperature reaches the target temperature, the fusing control circuit 104 is set to OFF state (step S209), and heater activation control is terminated.

JP-2006-039027-A discloses an image forming apparatus having a configuration to prevent overshooting and power shortage. In this configuration, even if the input voltage by a power source fluctuates, the input offset power when activating the heater can be maintained at a constant level, and the offset power can be changed depending on the target temperature of the heater, by which the temperature control may be conducted without overshooting and power shortage.

In the configuration described above, a voltage detector to detect the input voltage by the power source is disposed at a stage before the heater control circuit, in which the input voltage of the power source can be detected when the power source switch is set ON. However, the voltage detector cannot detect the actual voltage at the both ends of the heater, at which a voltage drop may occur when the heater is turned to ON. As such, the conventional heater activation control may be conducted using a detection voltage different from the actual voltage at the both ends of the heater, causing overshooting and power shortage at the heater.

SUMMARY

In one aspect of the present invention, a current-supply control unit for controlling current supply to a heating element is devised. The current-supply control unit includes a voltage detector to detect voltage at both ends of the heating element, and a heating element control unit to control a duty cycle of current supply for the heating element based on the voltages detected by the voltage detector when current is supplied to the heating element.

In another aspect of the present invention, a method of controlling current supply to a heating element is devised.

The method includes the steps of detecting voltage at both ends of the heating element using a voltage detector; and controlling a duty cycle of current supplied to the heating element based on the voltages detected at both ends of the heating element in the detecting step when current is supplied to the heating element.

In another aspect of the present invention, a non-transitory computer readable carrier medium storing a program for executing a method of controlling current supply to a heating element, which when executed causes a computer to perform the method of controlling current supply to the heating element, is devised. The method includes the steps of detecting voltage at both ends of the heating element using a voltage detector; and controlling a duty cycle of current supplied to the heating element based on the voltages detected at both ends of the heating element in the detecting step when current is supplied to the heating element.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 14A shows a stabilizing period of activation current of the fusing heater of FIG. 13 having a greater Watt number after heater is ON; and FIG. 14B shows a stabilizing period of activation current of the fusing heater of FIG. 13 having a smaller Watt number after heater is ON.

Figure 1:
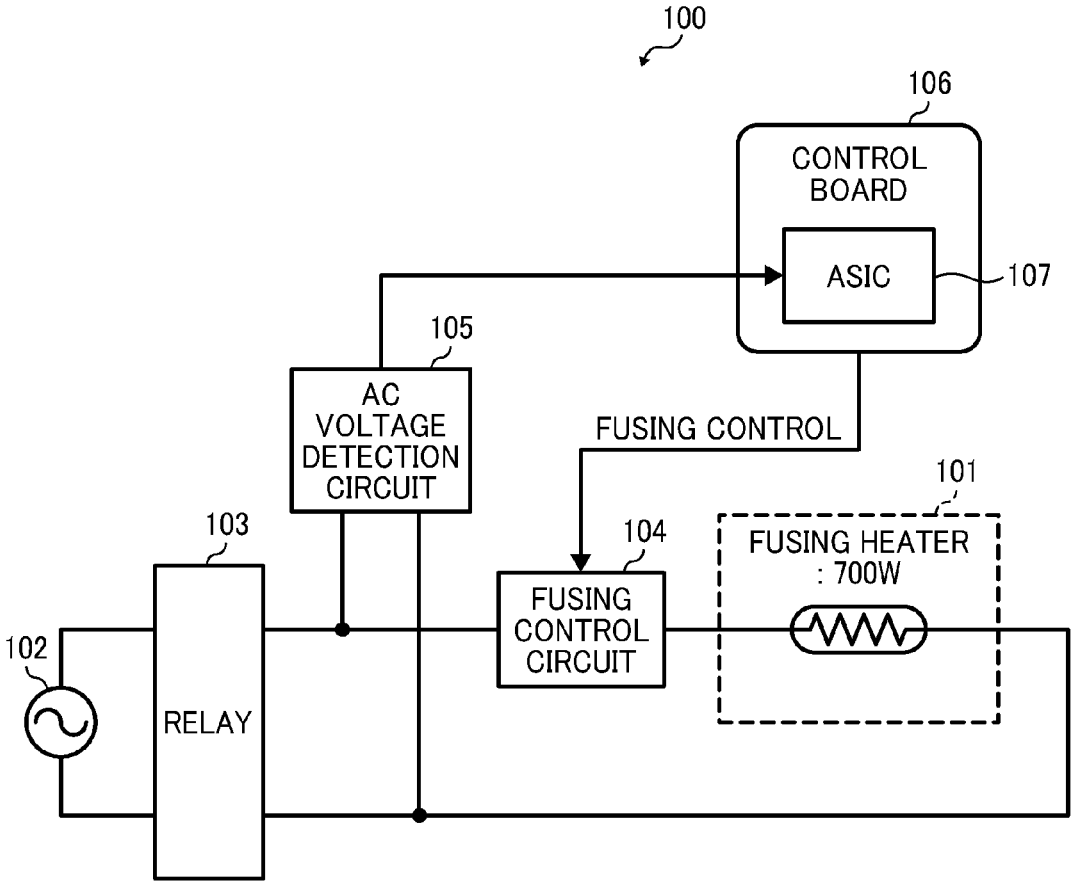
FIG. 1 RELATED ART
FIG. 1 shows a schematic configuration of circuitry of a conventional fusing device.
Figure 2:
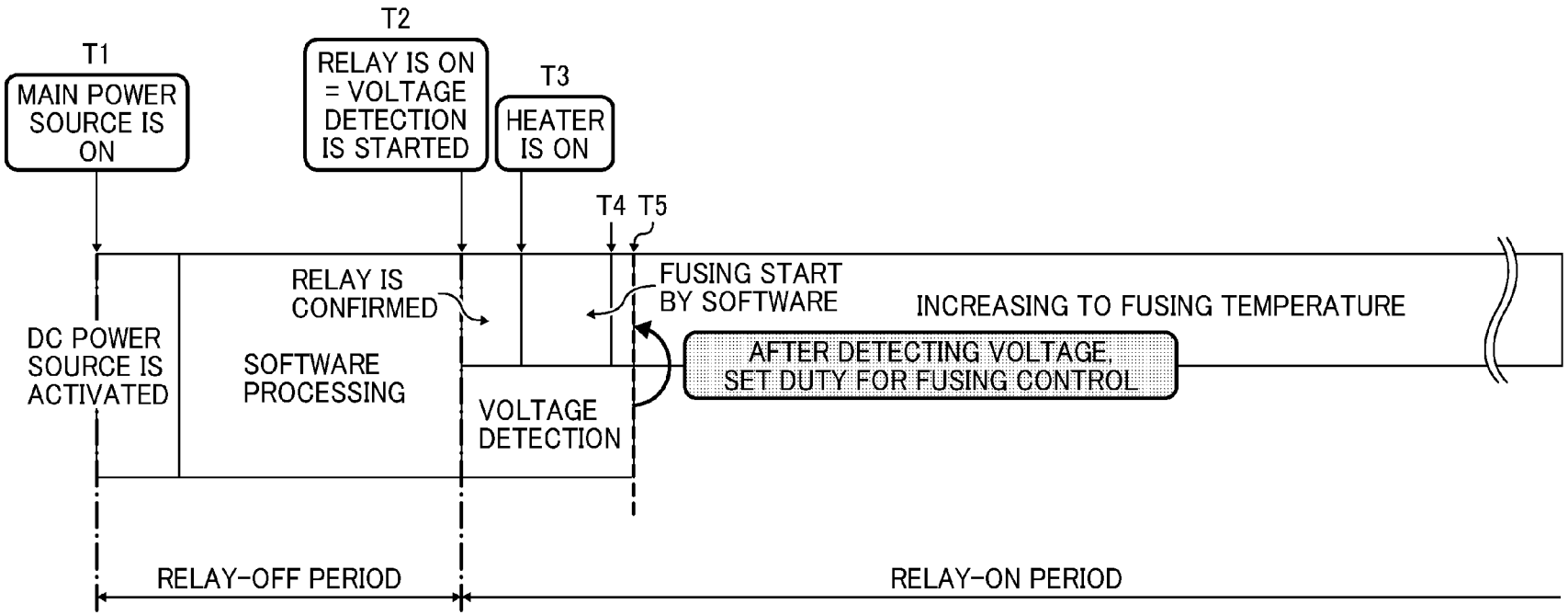
FIG. 2 RELATED ART
FIG. 2 shows an operation timing chart of operations performed by the conventional fusing device of FIG. 1.
Figure 3:
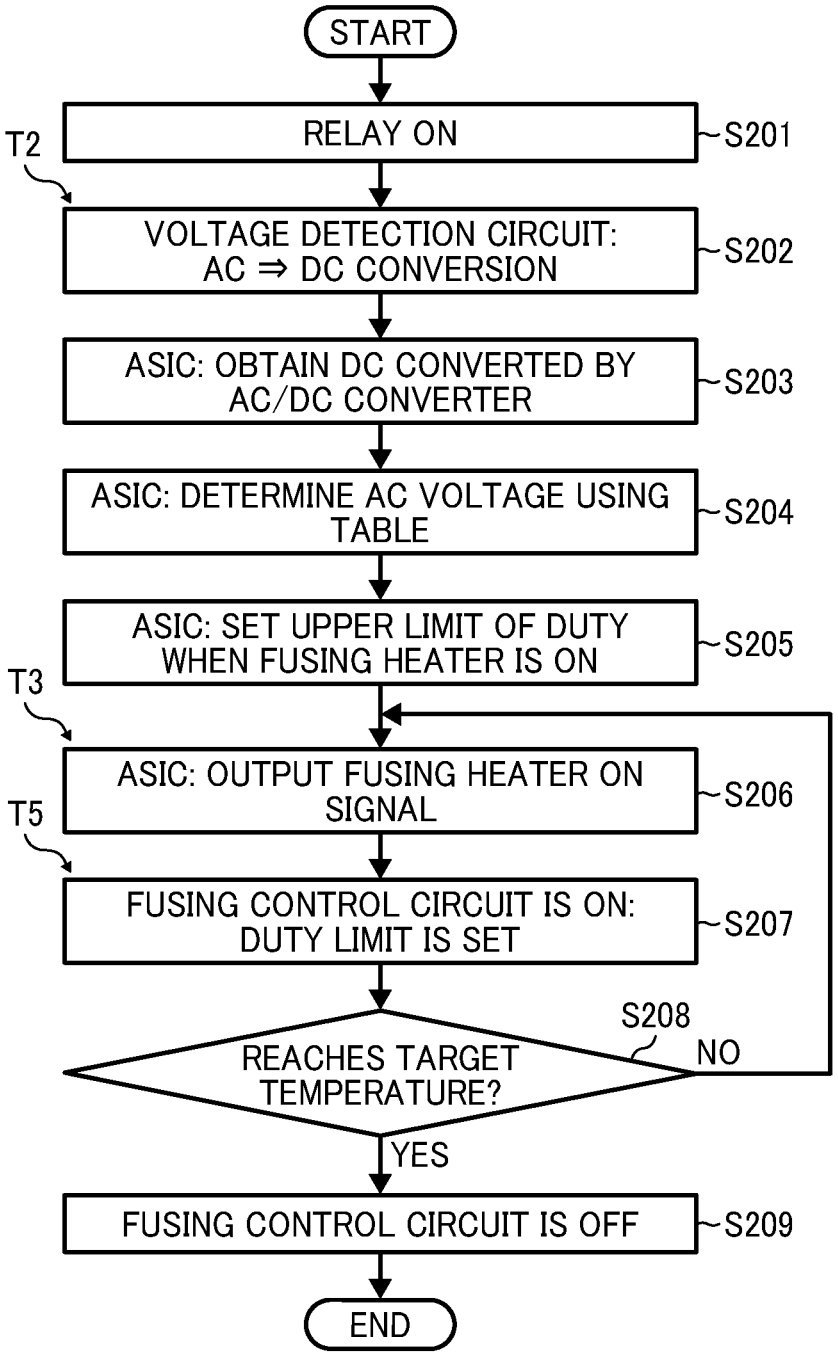
FIG. 3 RELATED ART
FIG. 3 is a flow chart showing steps in a control process executed by the conventional fusing device of FIG. 1.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner and achieve a similar result. Referencing now to the drawings, apparatuses or systems according to embodiments are described hereinafter.

First Embodiment

Figure 4:
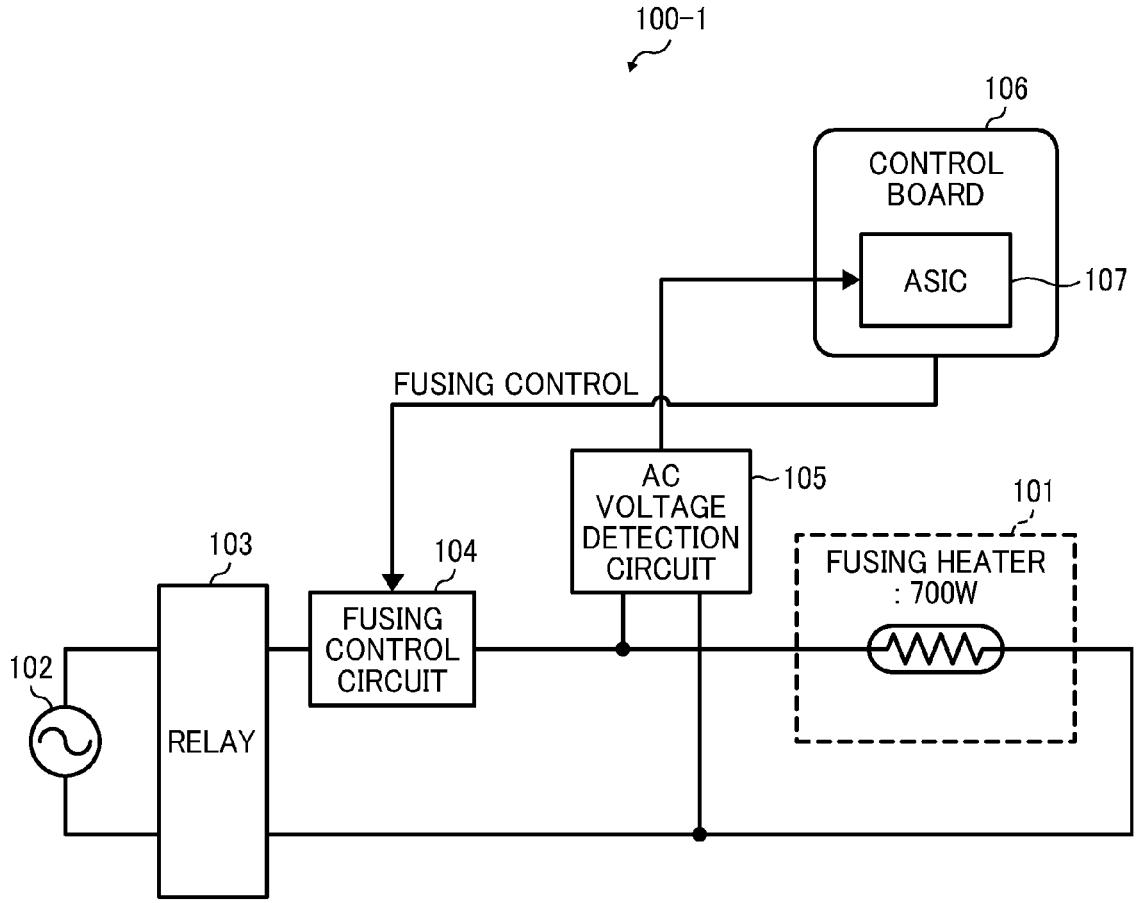
FIG. 4 shows a schematic block diagram of circuitry for a fusing device according to a first embodiment.

A description is given of an apparatus according to a first embodiment with reference to FIG. 4. FIG. 4 is a block diagram of a circuit configuration of a fusing device 100-1. Compared to a conventional configuration shown in FIG. 1, the arrangement position of the fusing control circuit 104 and the AC voltage detection circuit 105 are switched in a configuration shown in FIG. 4. Specifically, the AC voltage detection circuit 105 is disposed after the fusing control circuit 104 (i.e., between the fusing control circuit 104 and the fusing heater 101). Other units are arranged as same as the conventional configuration shown in FIG. 1.

As such, the AC voltage detection circuit 105, which is a detector to detect the voltage input by a power source, is disposed after the fusing control circuit 104 when the AC voltage detection circuit 105 is viewed from the AC power source 102, and thereby the input voltage by the power source can be detected only when the fusing heater 101 is set to ON state. Because the AC voltage detection circuit 105 can detect the actual voltage at the both ends of the fusing heater 101, the ASIC 107 can set the duty cycle of the fusing heater 101 and control the temperature of the fusing heater 101 based on the detected actual voltage.

Further, the power consumption of the AC voltage detection circuit 105 occurs only when the fusing heater 101 is at ON state, and thereby the power consumption of the fusing device 100-1 can be reduced compared to the conventional fusing device shown in FIG. 1. Further, instead of the ASIC 107, a central processing unit (CPU) 2, to be described later, can be used to control the fusing temperature.

Figure 5:
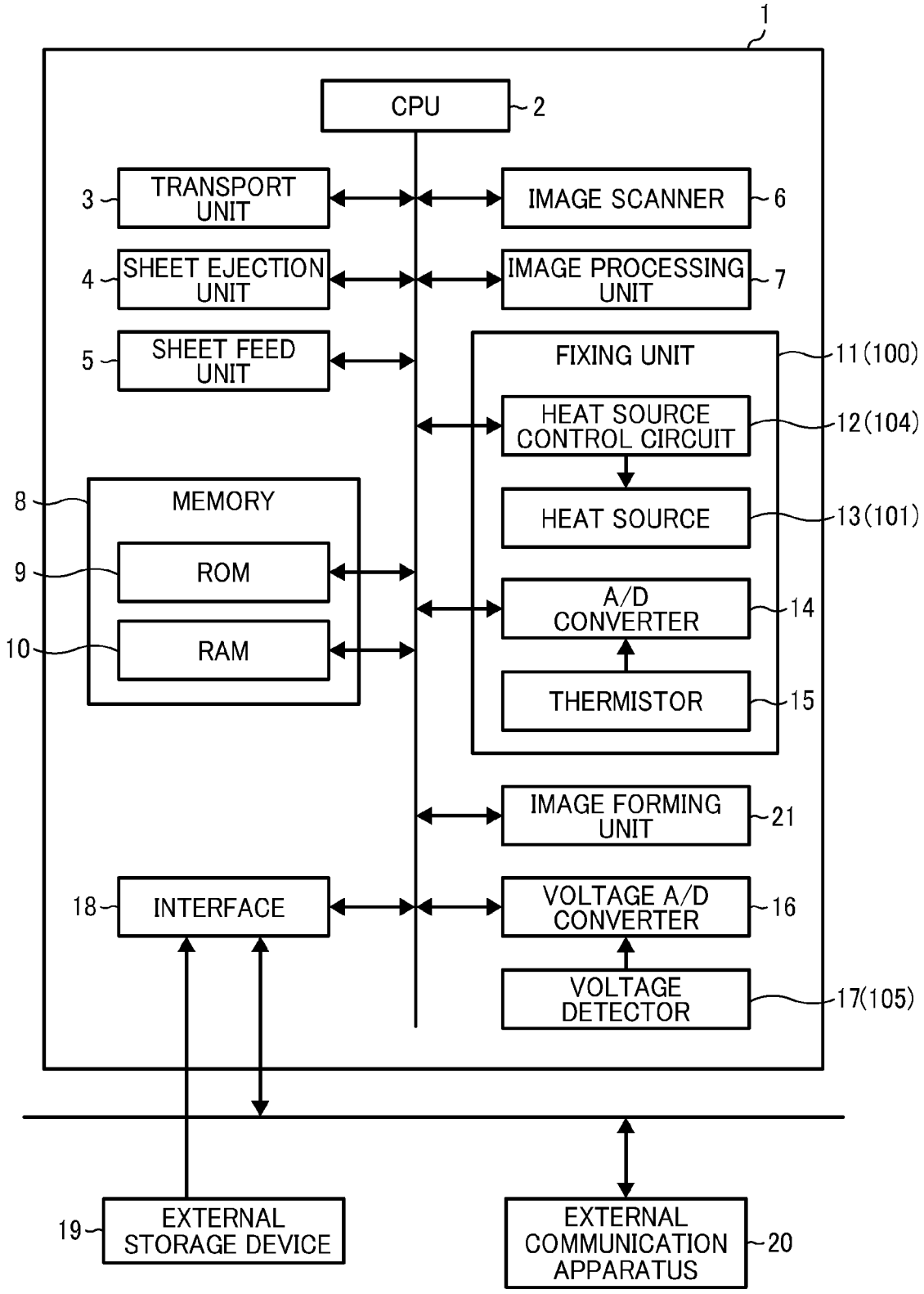
FIG. 5 shows a functional block diagram of an image forming apparatus employing the fusing device of FIG. 4.

FIG. 5 is a block diagram of an image forming apparatus 1 employing the fusing device 100-1 shown in FIG. 4. As for the image forming apparatus 1, each unit can be connected to the central processing unit (CPU) 2 via a bus, and the CPU 2 can control each unit to execute functions of the image forming apparatus 1. The image forming apparatus 1 includes, for example, the CPU 2, an image scanner 6, an image processing unit 7, an image forming unit 21, a fixing unit 11, a voltage detector 17, a transport unit 3, a sheet ejection unit 4, a sheet feed unit 5, a memory 8, and an interface 18. The fixing unit 11 of FIG. 5 corresponds to the fusing device 100-1 of FIG. 4.

The image scanner 6 scans document images. The image processing unit 7 processes the image data scanned by the image scanner 6 or image data received from an external device as printable image data, and outputs as print data. The image forming unit 21 forms an image on a recording medium such as sheet and paper based on the print data output from the image processing unit 7. The fixing unit 11 fuses a toner image on a sheet by applying heat and pressure. The sheet such as paper is transported to the image forming unit 21 from the sheet feed unit 5 using the transport unit 3. After forming and fusing the toner image on the sheet, the sheet is ejected by the sheet ejection unit 4.

The memory 8 includes a read only memory (ROM) 9 and a random access memory (RAM) 10. The ROM 9 stores program codes executable by the CPU 2. The CPU 2 reads out the program codes from the ROM 9, loads on the RAM 10 using the RAM 10 as a data buffer, by which the CPU 2 executes a software program defined by the program codes and controls each unit. The RAM 10 stores control data and image data. Further, the RAM 10 stores detection voltage temporarily, and the ROM 9 can store a fusing control pattern data permanently.

The fixing unit 11 includes a heat source control circuit 12, a heat source 13, a thermistor 15, an analog/digital (A/D) converter 14, and a thermistor 15. The heat source 13 may be also referred to as a heating element.

The heat source control circuit 12 controls the heat source 13 to fuse the toner image on a sheet such as paper using heat. The thermistor 15 detects the temperature of a heat roller and a fusing roller. The A/D converter 14 converts an analog data detected by the thermistor 15 to a digital data to be processed by the CPU 2, and reports the digital data to the CPU 2 (A/D conversion). The voltage detector 17 conducts voltage detection, which can be used for preventing overshooting and power shortage. The voltage A/D converter 16 converts an analog data of voltage detected by the voltage detector 17 to digital data of voltage to be processed by the CPU 2, and reports the digital data to the CPU 2 (A/D conversion).

The interface 18 can be used a connection unit, which is connectable to an external communication apparatus 20 such as a personal computer (PC), and an external storage device 19 such as a hard disk drive (HDD). The image forming apparatus 1 can receive image data from an external apparatus via the interface 18.

The fixing unit 11 of the image forming apparatus 1 corresponds to the fusing device 100-1 of FIG. 4. The heat source 13 of the image forming apparatus 1 corresponds to the fusing heater 101 of FIG. 4. The heat source control circuit 12 of the image forming apparatus 1 corresponds to the fusing control circuit 104 of FIG. 4. The voltage detector 17 of the image forming apparatus 1 corresponds to the AC voltage detection circuit 105 of FIG. 4.

Figure 6:
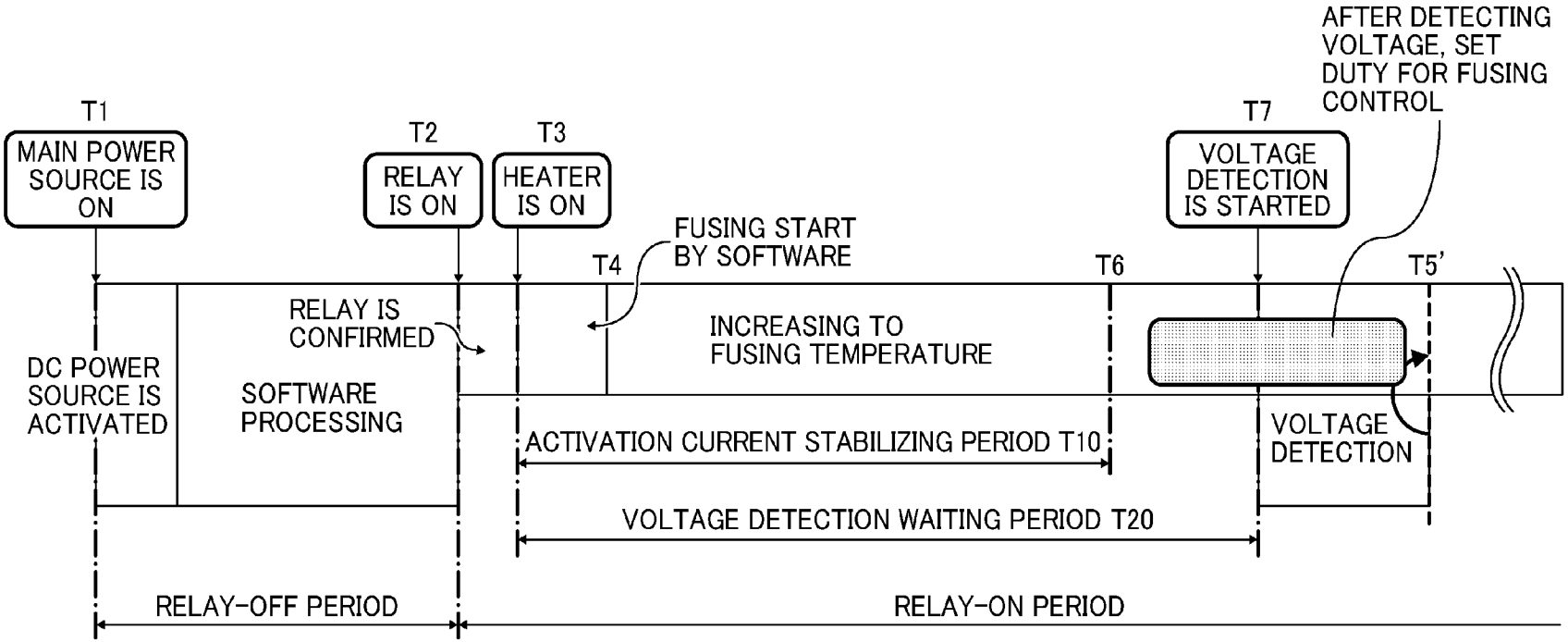
FIG. 6 shows an operation timing chart of operations performed by the fusing device according to a first embodiment.
Figure 7:
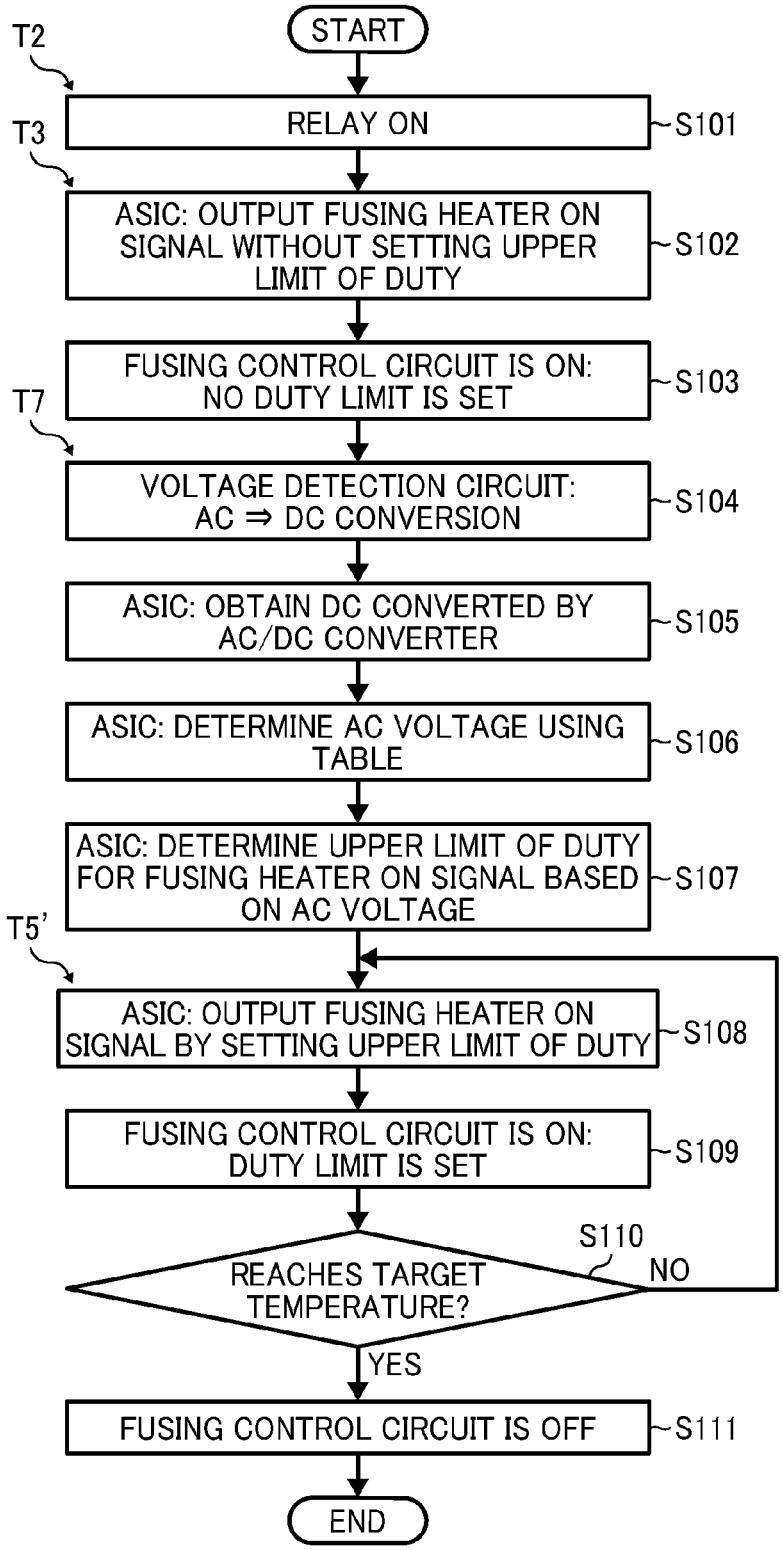
FIG. 7 is a flow chart showing steps of a control process according to a first embodiment.

FIG. 6 shows an operation timing chart of the fusing device 100-1, and FIG. 7 is a flow chart showing steps of control process of the fusing device 100-1 of first embodiment. As for first embodiment, the fusing device 100-1 has a control sequence to start the voltage detection after confirming stabilization of activation current, wherein the time period required to stabilize the activation current may be referred to as "activation current stabilizing period."

When the main power source is set ON (timing T1 of FIG. 6), the DC power source is activated and a given software processing is executed, and the relay 103 is set ON (timing T2 of FIG. 6). When the ON state of relay 103 is confirmed, the fusing control circuit 104 is set ON, and the fusing heater 101 is set ON (timing T3 of FIG. 6).

When the fusing heater 101 is set to ON state, the fusing control by software starts, and an activation current stabilizing period T10 and a voltage detection waiting period T20 starts simultaneously. The activation current stabilizing period T10 continues until the temperature of the fusing heater 101 is increased to a given temperature (timing T6 of FIG. 6). Then, when the voltage detection waiting period T20 ends or elapses, the voltage detector 17 (or AC voltage detection circuit 105) starts the voltage detection (timing T7 of FIG. 6).

Then, based on the detected voltage, the process after step S107 is conducted (timing T5'), and the heater activation control is terminated when the temperature of the fusing heater 101 reaches the target temperature.

As such, the heater activation control continues until the temperature of the fusing heater 101 is increased to the target temperature, and is terminated when the temperature of the fusing heater 101 becomes the target temperature. After conducting such heater activation control, the fusing temperature can be maintained using other control method. With such a configuration, the overshooting and power shortage can be prevented. The heater activation control according to a first embodiment is being conducted from the timing T1 until T5'.

The operation of timing chart of FIG. 6 corresponds to the flow chart of FIG. 7 as follows. When the relay 103 is set ON state at timing T2 (step S101), the ASIC 107 outputs the fusing heater ON signal to the fusing control circuit 104 without setting the upper limit of duty cycle (timing T3, step S102).

The fusing control circuit 104 is set to ON state by the fusing heater ON signal, and starts the current-supply control of the fusing heater 101 (step S103). Because the upper limit of duty cycle is not set (step S102), the fusing control circuit 104 conducts the current-supply control without setting limit for duty cycle. Upon setting the fusing heater 101 to ON state, the software-start fusing control, the activation current stabilizing period, and the voltage detection waiting period start.

Then, the software-start fusing control ends at timing T4, and the activation current stabilizing period T10 ends or elapses at timing T6, and further the voltage detection waiting period T20 ends or elapses at timing T7. Then, the voltage detection by the AC voltage detection circuit 105 can be started from timing T7.

When the voltage detection is started at timing T7, the AC voltage detection circuit 105 conducts AC/DC conversion (step S104), then the ASIC 107 receives the DC from the AC voltage detection circuit 105 using an AC converter (step S105).

The ASIC 107 determines the AC voltage based on a table stored in the ASIC 107 (step S106). Then, the ASIC 107 determines the upper limit of duty cycle when the fusing heater 101 is set to ON state based on the AC voltage (step S107). The ASIC 107 outputs the fusing ON signal (or fusing heater ON signal) to the fusing control circuit 104 by setting the upper limit of duty cycle (step S108).

The fusing control circuit 104, set to ON state by the fusing ON signal, conducts the current-supply control of the fusing heater 101 while the duty cycle limit is set (step S109).

During the ON state of the fusing control circuit 104, a temperature detected by a heater temperature sensor or detector and the target fusing temperature of the heater are compared (step S110). The processes from step S108 to step S110 are repeated until the temperature of heater reaches the target temperature. When the temperature of heater reaches the target temperature, the fusing control circuit 104 is set to OFF state (step S111), by which the heater activation control of the fusing heater is terminated.

Figure 8:
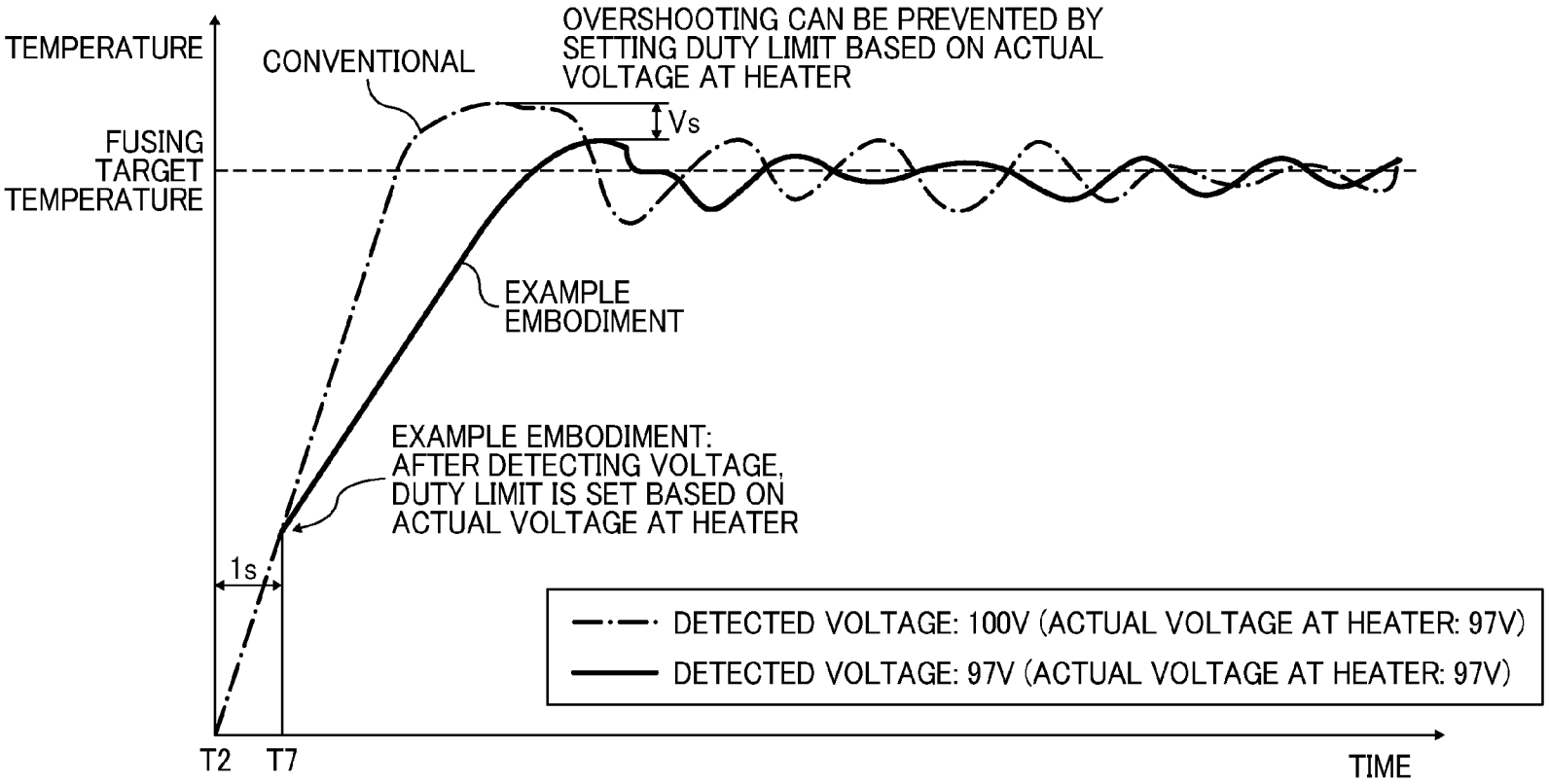
FIG. 8 shows a temperature profile of a fusing heater over time according to a first embodiment.

FIG. 8 shows temperature profile of the fusing heater over time. FIG. 8 shows a temperature profile for conventional art and a temperature profile according to a first embodiment to compare the conventional art and first embodiment. In the conventional art, when the relay 103 is set to ON state at timing T2 (FIG. 8), the current supply is started, and the voltage detection at the both ends of the fusing heater 101 is started promptly, and the ON/OFF duty cycle is controlled based on the detected voltage.

In contrast, in first embodiment, when the relay 103 is set to ON state at timing T2 (see FIG. 8), the voltage detection at the both ends of the fusing heater 101 is not started promptly. Instead, when the activation current stabilizing period T10 and the voltage detection waiting period T20 ends or elapses (timing T7), the voltage detection is started. After completing the voltage detection, the duty cycle limit is set based on the detected actual voltage applied to the fusing heater 101. The current-supply control of the fusing heater 101 can be conducted as such.

In a conventional art, a commercial power source of 100 V (volts) is detected when the current-supply control of the fusing heater is started. Based on the detected 100 V, the ON/OFF duty cycle of fusing heater 101 is set, and the current-supply control for the fusing heater 101 is conducted by setting 100 V as the detection voltage.

In contrast, in a first embodiment, as shown in FIG. 6, after the relay 103 is set ON state, a transitional period continue for some time until the voltage is stabilized. Then, the actual voltage at the both ends of the fusing heater 101 is detected, and the ON/OFF duty cycle of fusing heater 101 is set based on the detected actual voltage. With such a configuration, the overshooting becomes small for a first embodiment, and the temperature can be controlled in a stable manner as shown in FIG. 8. In a first embodiment, timing T7 may come one (1) second or so after the relay 103 is set to ON state (timing T2), and the temperature of the fusing heater 101 is increased to a target fusing temperature about ten (10) seconds after the relay 103 is set to ON state (timing T2) and then the target fusing temperature can be maintained.

Further, after timing T7, the actual voltage may become about 97 V, which means a voltage of 100 V at timing T2 drops for about 3 V. Such voltage drop may cause a fluctuation of power consumption (hereinafter, referred to as "Watt number") of the fusing heater 101 especially if the power consumption of the fusing heater 101 is great. In conventional arts, such voltage drop may cause the power shortage when the fusing heater 101 is heated. In contrast, in a first embodiment, because the voltage is controlled using the actual voltage, the power shortage may not occur.

Second Embodiment

A description is given of second embodiment including a configuration using a plurality of fusing heaters, and a simultaneous ON control is conducted for the plurality of fusing heaters. In a second embodiment, one AC voltage detection circuit is disposed for one of the fusing heaters using greater or greatest Watt number.

Figure 9:
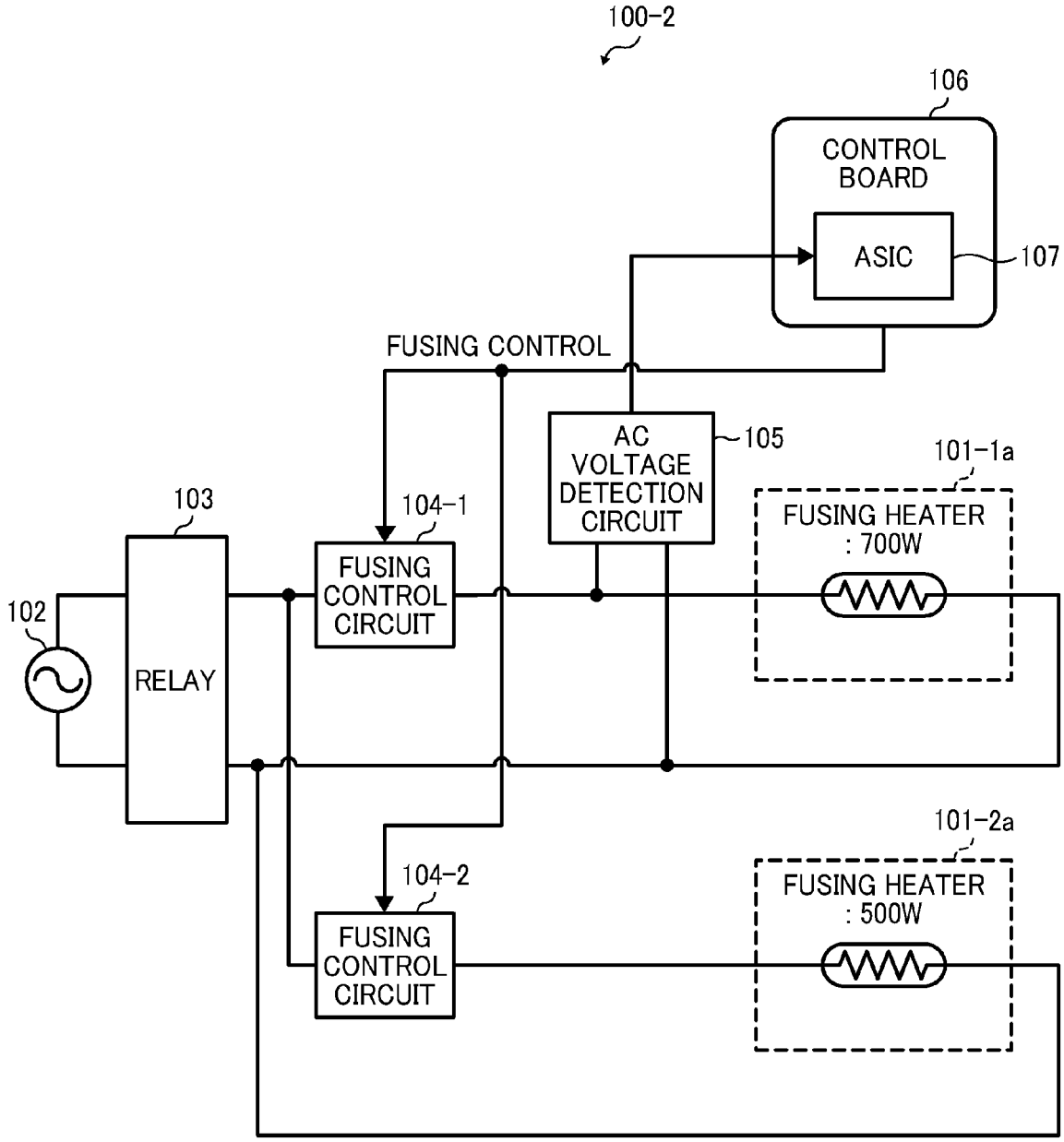
FIG. 9 shows a schematic block diagram of circuitry for a fusing device according to a second embodiment.

FIG. 9 is a block diagram of circuit configuration of a fusing device 100-2 according to a second embodiment. Compared to a first embodiment, in a second embodiment, a plurality of fusing heaters (e.g. two heaters) such as fusing heaters 101-1*a* and 101-2*a* are disposed, and fusing control circuits 104-1 and 104-2 are respectively disposed for the fusing heaters 101-1*a* and 101-2*a*. It should be noted the number of fusing heaters is not limited to two.

In a second embodiment, the AC voltage detection circuit 105 is disposed to only one current circuit connected to one of the fusing heaters. For example, the AC voltage detection circuit 105 is disposed for the fusing heater 101-1*a* as shown in FIG. 9. The parts or units same or similar to first embodiment are assigned with same or similar reference characters and/or numbers, and the explanation of such parts or units may be omitted.

In the fusing device 100-2 of a second embodiment, the fusing heater 101-1*a*/fusing control circuit 104-1, and the fusing heater 101-2*a*/fusing control circuit 104-2 are disposed after the relay 103 in parallel. Hereinafter, the fusing heater 101-1*a* and the fusing control circuit 104-1 may be referred to the first fusing heater 101-1*a* and the first fusing control circuit 104-1, and the fusing heater 101-2*a* and the fusing control circuit 104-2 may be referred to the second fusing heater 101-2*a* and the second fusing control circuit 104-2.

The first fusing control circuit 104-1 and the second fusing control circuit 104-2 are connected to the ASIC 107 of the control board 106, and are controlled by the ASIC 107 as similar to the fusing control circuit 104 shown in first embodiment.

In a second embodiment, the first fusing heater 101-1*a* is used to detect the actual voltage applied to the heater. In a second embodiment, for example, the first fusing heater 101-1*a* uses, for example, 700 W (Watts) for power consumption, and the second fusing heater 101-2*a* uses, for example, 500 W for power consumption.

In such configured fusing device 100-2 having two fusing heaters, the AC voltage detection circuit 105 is disposed between the first fusing control circuit 104-1 and the first fusing heater 101-1*a* of 700 W, which uses greater or greatest activation current for increasing the temperature to a target temperature. The AC voltage detection circuit 105 detects the actual voltage at the both ends of the first fusing heater 101-1*a*.

Based on the detected actual voltage, the ASIC 107 instructs an ON/OFF duty cycle to the first fusing control circuit 104-1 and second fusing control circuit 104-2. Based on the ON/OFF duty cycle instruction, the first fusing control circuit 104-1 and second fusing control circuit 104-2 respectively control the current supply to the first fusing heater 101-1*a* and second fusing heater 101-2*a*.

As such, the actual voltage at the both ends of the first fusing heater 101-1*a* having greater or greatest Watt number is detected, and then the ON/OFF duty cycle is set for the first and second fusing heaters 101-1*a* and 101-2*a*. Such configuration can reduce the difference between the actual voltage of the second fusing heater 101-2*a* and the detection voltage of the first fusing heater 101-1*a* compared to a configuration detecting the actual voltage at the both ends of the second fusing heater 101-2*a* having the smaller Watt number.

In a second embodiment, one AC voltage detection circuit is disposed to the fusing heater having greater or greatest Watt number, by which the difference between the actual voltage and the detection voltage can be reduced compared to a configuration that disposes one AC voltage detection circuit to a fusing heater having smaller or smallest Watt number.

Third Embodiment

A description is given of a third embodiment including a configuration using a plurality of fusing heaters, and non-simultaneous ON control (or time-shift ON control). In a third embodiment, one AC voltage detection circuit is disposed for one fusing heater which is set to ON state at earlier or earliest timing compared to other fusing heater.

Figure 10:
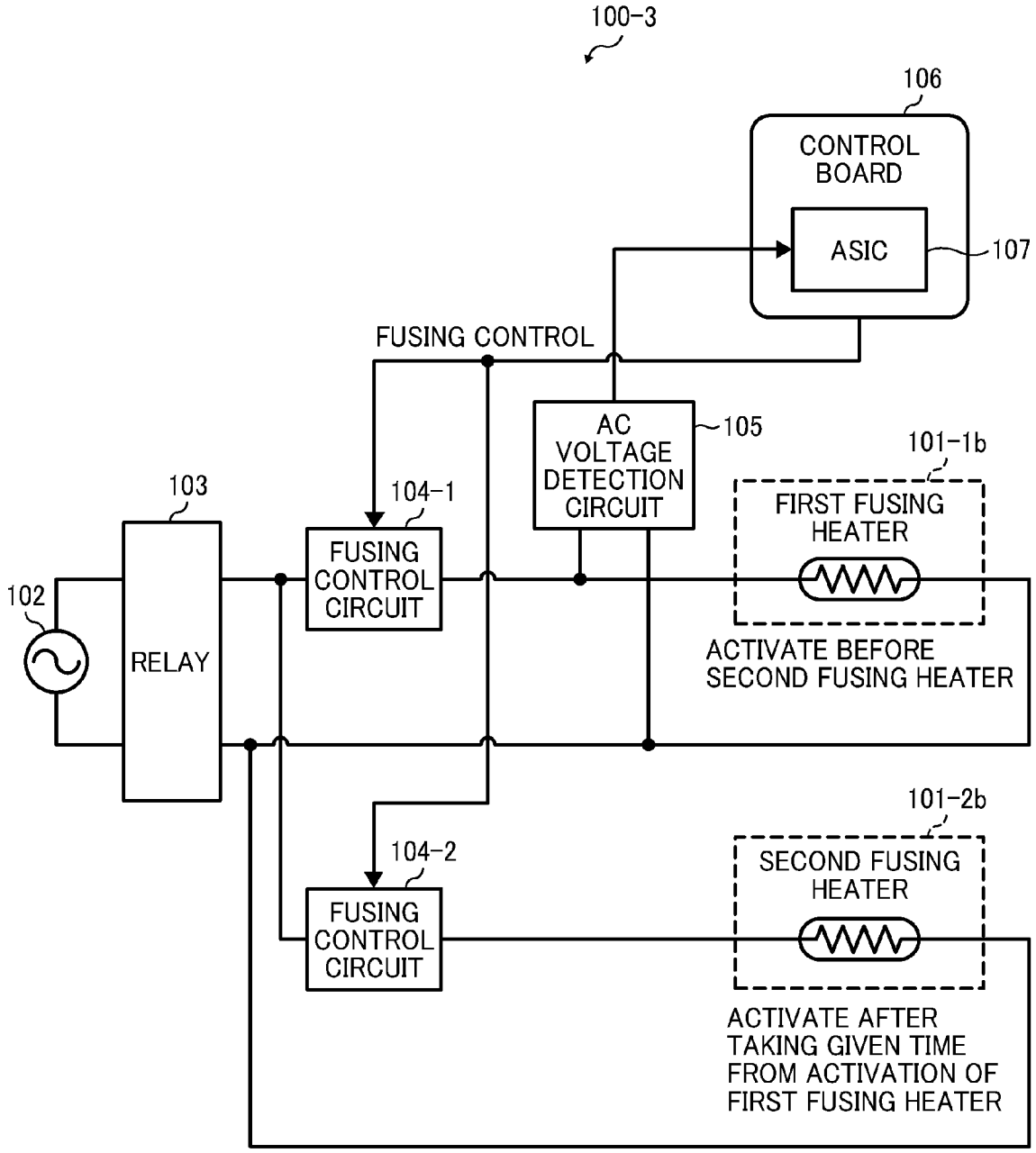
FIG. 10 shows a schematic block diagram of circuitry for a fusing device according to a third embodiment.

FIG. 10 is a block diagram of circuit configuration of a fusing device 100-3 according to a third embodiment. As similar to a second embodiment, a plurality of fusing heaters (e.g. two heaters) such as a fusing heaters 101-1*b* and 101-2*b* are disposed, and fusing control circuits 104-1 and 104-2 are respectively disposed for the fusing heaters 101-1*b* and 101-2*b*. It should be noted the number of fusing heaters is not limited to two.

In a third embodiment, the AC voltage detection circuit 105 is disposed to only one current circuit of one of the fusing heaters. For example, the AC voltage detection circuit 105 is disposed for the fusing heater 101-1*b* as shown in FIG. 10. The parts or units same or similar to first embodiment are assigned with same or similar reference characters and/or numbers, and the explanation of such parts or units may be omitted.

In the fusing device 100-3, the fusing heater 101-1*b*/fusing control circuit 104-1, and the fusing heater 101-2*b*/fusing control circuit 104-2 are disposed after the relay 103 in parallel. The first fusing control circuit 104-1 and the second fusing control circuit 104-2 are connected to the ASIC 107 of the control board 106, and controlled by the ASIC 107 as similar to the fusing control circuit 104 shown in first embodiment. In third embodiment, the first fusing heater 101-1*b* is used to detect the actual voltage of heater.

In a third embodiment, the current-supply start timing is set differently or independently for the first and second fusing heaters 101-1d and 101-2*b*. Specifically, the first fusing heater 101-1*b* is set to ON state at a timing earlier than the second fusing heater 101-2*b*. The AC voltage detection circuit 105 is disposed at the both ends of the first fusing heater 101-1*b* which is set to ON state at an earlier timing. In a third embodiment, the first fusing heater 101-1*a* and the second fusing heater 101-2*a* may use the same power consumption (i.e., Watt number).

Figure 11:
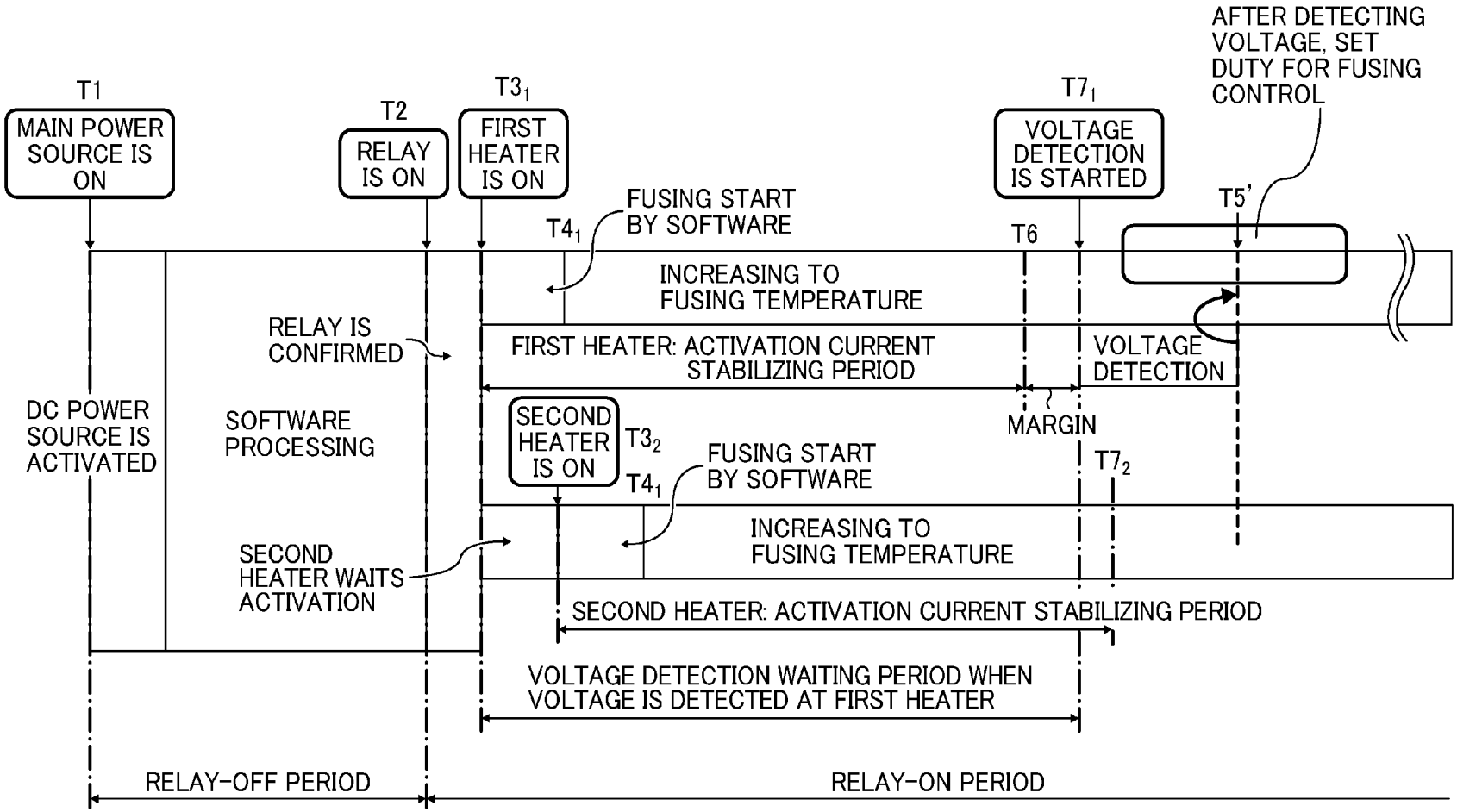
FIG. 11 shows an operation timing chart of the fusing device of the third embodiment.

FIG. 11 shows an operation timing chart of the fusing device 100-3 according to a third embodiment. The process until the timing T2 (i.e., setting the relay 103 at ON state) is same for a first embodiment and a third embodiment.

After confirming the ON state of the relay 103, the first fusing heater 101-1*b* is set to ON state (timing $T3_1$) at first, and the software start control for the first fusing heater 101-1*b* starts. At timing $T3_1$, a counter for counting the waiting period before setting ON state of the second fusing heater 101-2*b* is activated to count the waiting period before setting ON state, wherein such waiting period may be set in advance. When the waiting period before setting ON state ends or elapses, the second fusing heater 101-2*b* is set to ON state (timing $T3_2$). Upon setting ON state of the second fusing heater 101-2*b*, the software start control for the second fusing heater 101-2*b* starts.

When the activation current stabilizing period for the first fusing heater 101-1*b* ends or elapses and the temperature of heater is increased to a target temperature (timing T6), and the pre-set margin time ends or elapses (timing $T7_1$), the AC voltage detection circuit 105 detects the actual voltage at the both ends of the first fusing heater 101-1*b*. Then, the ON/OFF duty cycle of the first fusing heater 101-1*b* is set based on the detected actual voltage, and current having set with a given duty cycle is supplied to the first fusing heater 101-1*b* (timing T5'). The heater activation control can be conducted as shown in the flow chart of FIG. 7, and the processes from step S108 to step S110 are repeated until the temperature of heater reaches the target temperature. When the temperature of fusing heater 101-1*b* reaches the target temperature, the heater activation control of the fusing heater 101-1*b* is terminated.

Further, as for the second fusing heater 101-2*b*, after the second fusing heater 101-2*b* is set to ON state (timing $T3_2$), the activation current stabilizing period continues until timing $T7_2$, and then the ON/OFF duty cycle is set for the second fusing heater 101-2*b* as similar to the ON/OFF duty cycle of the first fusing heater 101-1*b* at timing T5', and current having set with a given duty cycle is supplied to the second fusing heater 101-2*b*.

As shown in FIG. 11, the start timing for detecting the voltage of the second fusing heater 101-2*b* is timing $T7_2$, which is later than timing $T7_1$. As for the above described fusing device using a plurality of fusing heaters, it is preferable to set the condition of timing T5' at an earlier timing to increase the temperature of heaters to a given temperature and stabilize the temperature at the given temperature. To increase and stabilize the temperature of heaters to a given temperature at an earlier timing, the voltage of fusing heater, which is supplied with current earlier than other fusing heater, is preferably detected, and the temperature of fusing heater is controlled based on the detection voltage.

In a third embodiment, the AC voltage detection circuit is disposed to a fusing heater to be set to ON state earlier than other fusing heater, by which the time to start the voltage detection can be set shorter.

Fourth Embodiment

A description is given of fourth embodiment including a configuration using a plurality of fusing heaters, and simultaneous ON control is conducted for the plurality of fusing heaters. In a fourth embodiment, one AC voltage detection circuit is disposed for one fusing heater using smaller or smallest Watt number.

Figure 12:
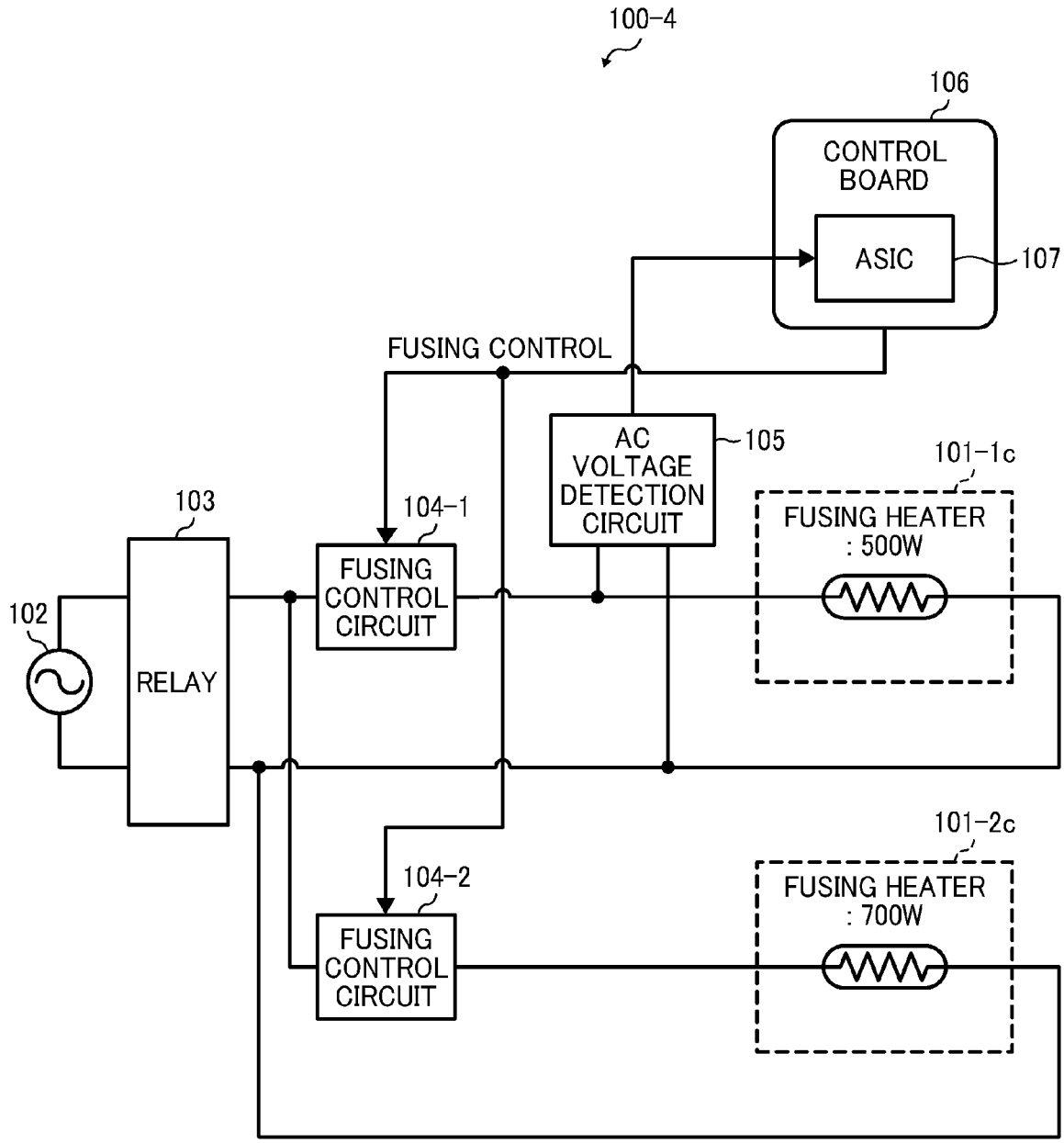
FIG. 12 is a block diagram of circuitry for a fusing device according to a fourth embodiment.

FIG. 12 is a block diagram of circuit configuration of a fusing device 100-4 according to a fourth embodiment. As similar to a second embodiment, in fourth embodiment, a plurality of fusing heaters (e.g. two heaters) such as fusing heaters 101-1*c* and 101-2*c* are disposed, and fusing control circuits 104-1 and 104-2 are respectively disposed for the fusing heaters 101-1*c* and 101-2*c*. Further, as similar to a second embodiment and third embodiment, one AC voltage detection circuit is disposed to only one of fusing heaters. The parts or units same or similar to first embodiment are assigned with same or similar reference characters and/or numbers, and the explanation of such parts or units may be omitted.

In the fusing device 100-4, the first fusing heater 101-1*c* uses a smaller Watt number (e.g., 500 W) and the second fusing heater 101-2*c* uses a greater Watt number (e.g., 700 W), which is opposite to a case of second embodiment.

Further, the AC voltage detection circuit 105 is disposed to detect the voltage at the both ends of the first fusing heater 101-1*c* having a smaller Watt number (e.g., 500 W). In a fourth embodiment, the first fusing heater 101-1*c* uses 500 W-power consumption, and the second fusing heater 101-2*c* uses 700 W-power consumption. The parts or units same or similar to second embodiment are assigned with same or similar reference characters and/or numbers, and the explanation of such parts or units may be omitted.

Figure 13:
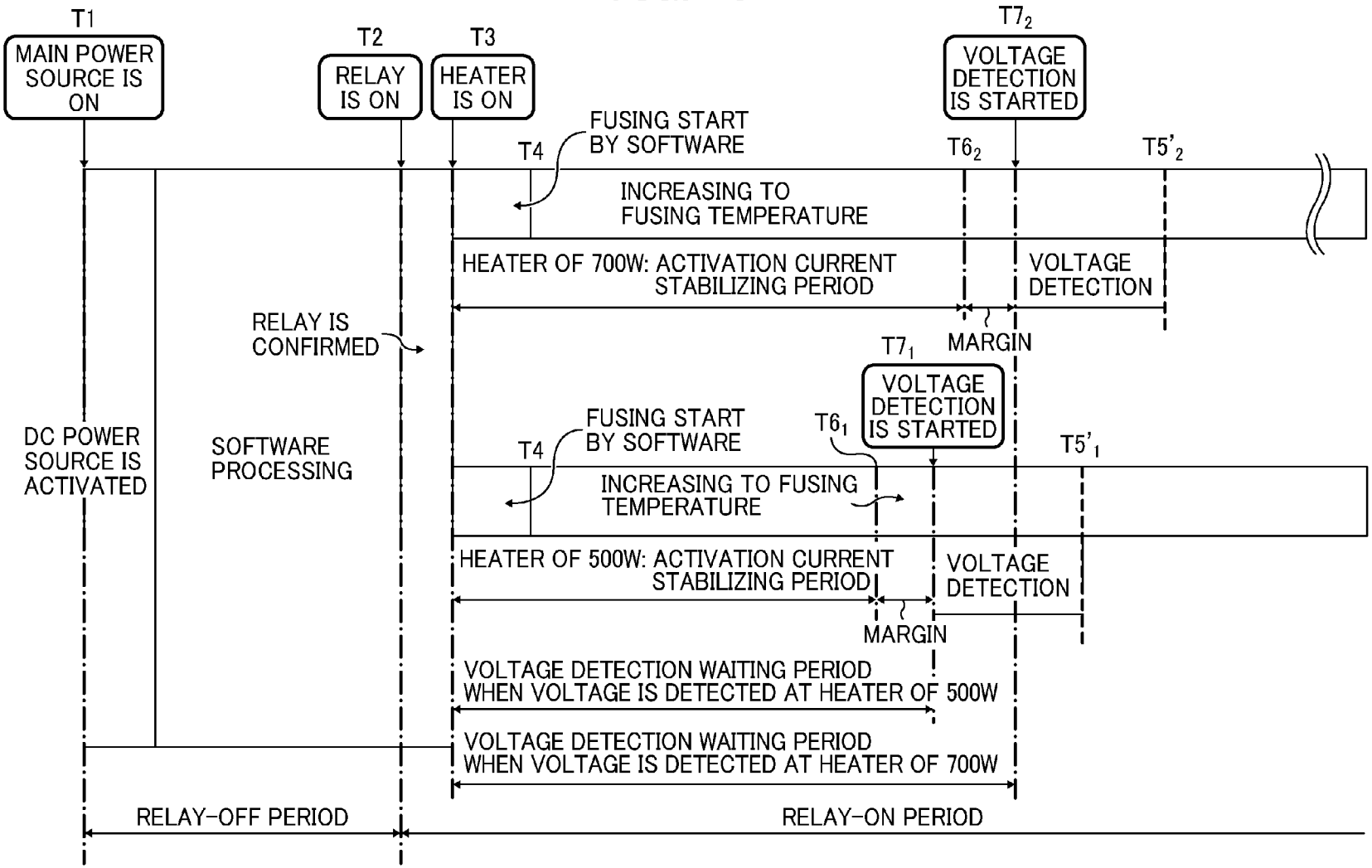
FIG. 13 shows an operation timing chart of fusing device of the fourth embodiment.

FIG. 13 shows an operation timing chart of the fusing device 100-4 according to a fourth embodiment. The process until timing T2 (i.e., setting the relay 103 at ON state), timing T3 for heater ON, and timing T4 for software-start fusing control are same for first embodiment and fourth embodiment.

When the activation current stabilizing period for the first fusing heater 101-1*c* having the smaller Watt number completes ($T6_1$), and when the pre-set margin time ends or elapses (timing $T7_1$), the AC voltage detection circuit 105 detects the actual voltage at the both ends of the first fusing heater 101-1*c* from timing $T7_1$ to timing $T5'_1$, and then current having set with the ON/OFF duty cycle is supplied to the first fusing heater 101-1*c* from timing $T5'_1$.

As for the second fusing heater 101-2*c* having the greater Watt number, the activation current stabilizing period for the second fusing heater 101-2*c* continues from the timing T3 when the first and second fusing heaters 101-1*c* and 101-2*c* are set ON until timing $T7_2$. Then, at timing $T5'_2$ that is after timing $T7_2$ for some time, current having set with the ON/OFF duty cycle is supplied to the second fusing heater 101-2*c* as similar to the first fusing heater 101-1*c*.

As for the current-supply control circuit for the fusing device 100-4 shown in FIG. 12, the AC voltage detection circuit 105 detects the actual voltage at the both ends of the first fusing heater 101-1*c* having smaller or smallest Watt number. Therefore, the second fusing heater 101-2*c* that the actual voltage is not detected can be controlled as similar to a case of third embodiment.

Further, in contrast, if the actual voltage diction is conducted at the second fusing heater 101-2*c* having greater Watt number instead of using the first fusing heater 101-1*c* having smaller Watt number, the operation of the second fusing heater 101-2*c* can be conducted as similar to the operation described in second embodiment detecting the actual voltage at the both ends of the fusing heater having greater Watt number for heater control. If the actual voltage diction is conducted at the second fusing heater 101-2*c*, the voltage diction starts timing $T7_2$ as shown in FIG. 13.

When comparing the voltage detection start timing $T7_1$ and $T7_2$ in FIG. 13, the activation current stabilizing period of the first fusing heater 101-1*c* having smaller Watt number is shorter than the activation current stabilizing period of the second fusing heater 101-2*c* having greater Watt number after setting the heaters at ON state, and thereby the voltage detection start timing for the first fusing heater 101-1*c* can be set earlier than the voltage detection start timing for the second fusing heater 101-2*c*.

Figure 14A:
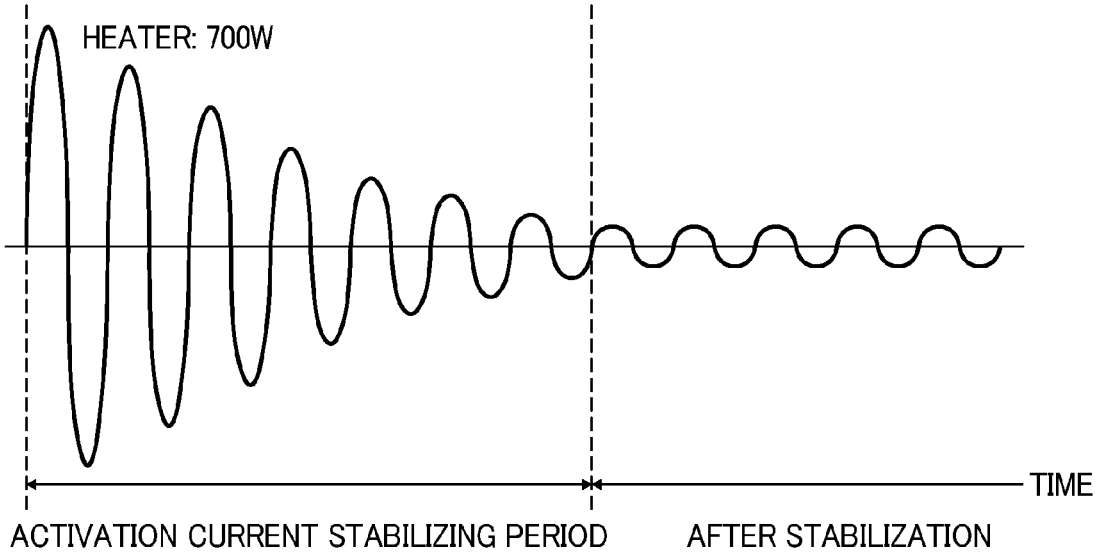
Figure 14B:
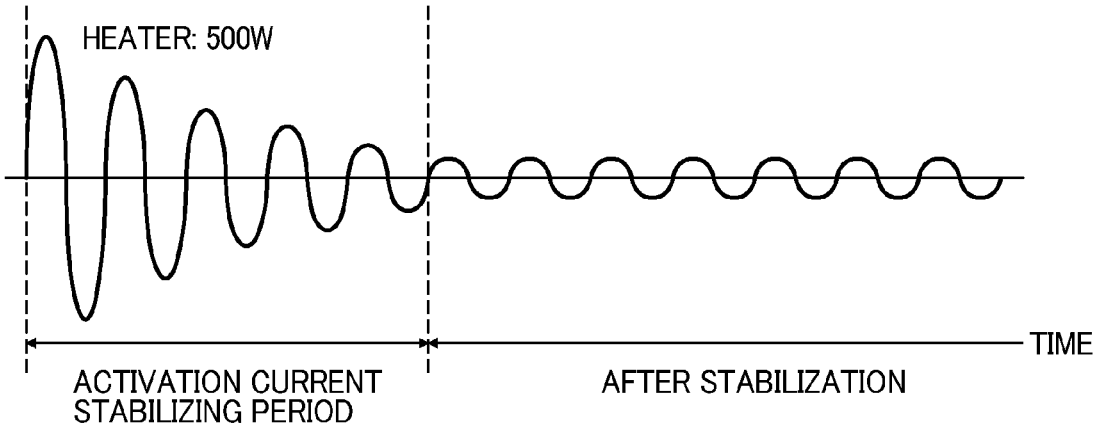

FIG. 14A shows a profile of activation current stabilizing period of the second fusing heater 101-2*c* having greater Watt number such as 700 W after setting the heater to ON state, and FIG. 14B shows a profile of activation current stabilizing period of the first fusing heater 101-1*c* having smaller Watt number such as 500 W after setting the heater to ON state.

When comparing FIGS. 14A and 14B, the activation current stabilizing period of the second fusing heater 101-2*c* having greater Watt number becomes longer than the activation current stabilizing period of the first fusing heater 101-1*c* having smaller Watt number.

Therefore, if the voltage is detected at the second fusing heater 101-2*c* having greater Watt number, the waiting time period to start the voltage detection becomes longer due to a longer period of activation current stabilizing period. Therefore, if the voltage is detected at the first fusing heater 101-1*c* having smaller Watt number as shown in fourth embodiment, the waiting time period to start the voltage detection can be set shorter.

In the above described embodiments, the AC voltage detection circuit 105 is disposed after the fusing control circuit 104 when viewed from a power source such as a commercial power source, and the AC voltage detection circuit 105 detects the voltage of the fusing heater 101. Specifically, the AC voltage detection circuit 105 detects the actual voltage at the both ends of the fusing heater 101. Because the heater activation control of the fusing heater is conducted based on the actual voltage of the fusing heater detected by the AC voltage detection circuit 105, the voltage control can be conducted without overshooting and power shortage.

Further, when a plurality of fusing heaters is used for simultaneous ON control, the AC voltage detection circuit is preferably disposed to a fusing heater having greater or greatest Watt number. Further, when a plurality of fusing heaters is used for non-simultaneous ON control (or time-shift ON control), the AC voltage detection circuit is preferably disposed to a fusing heater, which is set to ON state at earlier or earliest timing, or a fusing heater having smaller or smaller Watt number.

In a conventional art, the power is constantly consumed at the voltage detection circuit when the power source is at ON state. In the above described embodiments, the voltage detection is started at timing T7, which means the voltage detection waiting period T20 ends or elapses after the heater is set to ON state (timing T3), and thereby the power consumption may not occur to the voltage detection circuit during the voltage detection waiting period T20, by which the power saving effect can be attained.

In the above described embodiments, the fusing heater 101, the first fusing heaters 101-1*a*, 1*b*, 1*c*, and the second fusing heaters 101-2*a*, 2*b*, 2*c* correspond to a heating element. The AC voltage detection circuit 105 corresponds to a voltage detector. The fusing control circuit 104 corresponds to a control unit. The ASIC 107 corresponds to a main controller. The fusing device 100-1, -2, -3, -4 and the fixing unit 11 correspond to a fusing unit or device.

In the above described current-supply control unit, current-supply to the heating element can be controlled based on the actual voltage detected at the both ends of the heating element by the voltage detector. Further, the duty cycle of current-supply to the heating element can be controlled by the control unit based on the actual voltage detected at the heating element by the voltage detector when the current-supply is activated to the heating element. The current-supply to the heating element can be controlled by detecting the actual voltage at the both ends of the heating element, which is substantially same as the voltage of the power source input to the heating element, by which overshooting and power shortage when the current-supply is activated to the heating element can be prevented.

With employing the above described embodiments, a current-supply control for a heating unit to prevent overshooting and power shortage at the heating unit when a power supply is activated can be devised, and a fusing device employing the current-supply control of the heating unit, an image forming apparatus employing the fusing device, and a current-supply control method of the heating unit can be devised.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a Wireless Application Protocol (WAP) or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a flexible disk, a compact disk read only memory (CD-ROM), a digital versatile disk read only memory (DVD-ROM), DVD recording only/rewritable (DVD-R/RW), electrically erasable and programmable read only memory (EEPROM), erasable programmable read only memory (EPROM), a memory card or stick such as USB memory, a memory chip, a mini disk (MD), a magneto optical disc (MO), magnetic tape, a hard disk in a server, a solid state memory device or the like, but not limited these. The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

In the above-described embodiments, a computer can be used with a computer-readable program, described by object-oriented programming languages such as C++, Java (registered trademark), JavaScript (registered trademark), Perl, Ruby, or legacy programming languages such as machine language, assembler language to control functional units used for the apparatus or system. For example, a particular computer (e.g., personal computer, work station) may control an information processing apparatus or an image processing apparatus such as image forming apparatus using a computer-readable program, which can execute the above-described processes or steps. In the above described embodiments, at least one or more of the units of apparatus can be implemented in hardware or as a combination of hardware/software combination. In embodiments, processing units, computing units, or controllers can be configured with using various types of processors, circuits, or the like such as a programmed processor, a circuit, an application specific integrated circuit (ASIC), used singly or in combination.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A current-supply control unit for controlling current supply to a heating element, comprising:

a voltage detector to detect voltage at both ends of the heating element;

a heating element control unit to control a duty cycle of current supply for the heating element based on the voltages detected by the voltage detector when current is supplied to the heating element; and a plurality of heating elements connected in parallel and a plurality of heating element control units, each of the plurality of heating element control units connected serially to a corresponding one of the heating elements, wherein, when the plurality of heating elements is started to be supplied with current simultaneously, the voltage detector conducts voltage detection at a stage after the heating element control unit connected in series to the heating element having the greatest activation current among the plurality of heating elements.

2. The current-supply control unit of claim 1, wherein the voltage detector is disposed between the heating element control unit and the heating element.

3. The current-supply control unit of claim 1, further comprising a main controller to output a control signal to the heating element control unit, wherein the main controller outputs a heating element ON signal to the heating element control unit to start current supply to the heating element without setting a duty limit of current, wherein the heating element control unit supplies current to the heating element without setting the duty limit of current based on the heating element ON signal output from the main controller, wherein the voltage detector detects alternating current (AC) voltage at both ends of the heating element supplied with current and converts the AC voltage to direct current (DC) voltage, wherein the main controller determines a value of the AC voltage based on the converted DC voltage converted by the voltage detector and sets an upper limit of duty cycle of current to be supplied to the heating element based on the determined AC voltage, wherein the main controller outputs a heating element ON signal to the heating element control unit to supply current having the set upper limit of duty cycle to the heating element, wherein the heating element control unit controls current-supply to the heating element based on the set upper limit of duty cycle of current.

4. The current-supply control unit of claim 3, wherein the current having the set upper limit of duty cycle is repeatedly supplied to the heating element until a temperature of the heating element reaches a target temperature.

5. A fusing device, comprising:

the current-supply control unit of claim 1; and a heating element supplied with current using the current-supply control unit.

6. An image forming apparatus, comprising:

the fusing device of claim 5; and an image forming unit to form an image on a recording sheet using the fusing device.

7. A method of controlling current supply to a heating element, comprising:

detecting voltage at both ends of the heating element using a voltage detector;

controlling a duty cycle of current supplied to the heating element based on the voltages detected at both ends of the heating element in the detecting step when current is supplied to the heating element; and connecting a plurality of heating elements in parallel to a plurality of heating element control units, each of the plurality of heating element control units connected serially to a corresponding one of the heating elements, wherein, when the plurality of heating elements is started to be supplied with current simultaneously, the voltage detector conducts voltage detection at a stage after the heating element control unit connected in series to the heating element having the greatest activation current among the plurality of heating elements.

8. A non-transitory computer readable carrier medium storing a program for executing a method of controlling current supply to a heating element, which when executed causes a computer to perform the method of controlling current supply to the heating element, the method comprising the steps of claim 7.

9. A current-supply control unit for controlling current supply to a heating element, comprising:

a voltage detector to detect voltage at both ends of the heating element;

a heating element control unit to control a duty cycle of current supply for the heating element based on the voltages detected by the voltage detector when current is supplied to the heating element; and a plurality of heating elements connected in parallel and a plurality of heating element control units, each of the plurality of heating element control units connected serially to a corresponding one of the heating elements, wherein, when the plurality of heating elements is started to be supplied with current non-simultaneously, the voltage detector conducts voltage detection at a stage after the heating element control unit connected in series to the heating element activated earliest among the plurality of heating elements.

10. The current-supply control unit of claim 9, wherein the voltage detector is disposed between the heating element control unit and the heating element.

11. The current-supply control unit of claim 9, further comprising a main controller to output a control signal to the heating element control unit, wherein the main controller outputs a heating element ON signal to the heating element control unit to start current supply to the heating element without setting a duty limit of current, wherein the heating element control unit supplies current to the heating element without setting the duty limit of current based on the heating element ON signal output from the main controller, wherein the voltage detector detects alternating current (AC) voltage at both ends of the heating element supplied with current and converts the AC voltage to direct current (DC) voltage, wherein the main controller determines a value of the AC voltage based on the converted DC voltage converted by the voltage detector and sets an upper limit of duty cycle of current to be supplied to the heating element based on the determined AC voltage, wherein the main controller outputs a heating element ON signal to the heating element control unit to supply current having the set upper limit of duty cycle to the heating element, wherein the heating element control unit controls current-supply to the heating element based on the set upper limit of duty cycle of current.

12. The current-supply control unit of claim 11, wherein the current having the set upper limit of duty cycle is repeatedly supplied to the heating element until a temperature of the heating element reaches a target temperature.

13. A fusing device, comprising:

the current-supply control unit of claim 9; and a heating element supplied with current using the current-supply control unit.

14. An image forming apparatus, comprising:

the fusing device of claim 13; and an image forming unit to form an image on a recording sheet using the fusing device.

* * * * *